US005433088A

United States Patent [19]

Mahar

[11] Patent Number: 5,433,088

[45] Date of Patent: Jul. 18, 1995

[54] SNAP-ON EARRING CLASP

[76] Inventor: Charles S. Mahar, 13 N. San Francisco St., Flagstaff, Ariz. 86001

[21] Appl. No.: 838,031

[22] Filed: Feb. 20, 1992

[51] Int. Cl.[6] ..... A44C 7/00

[52] U.S. Cl. ..... 63/12; 24/669; 24/27

[58] Field of Search ..... 63/2, 13, 12; 24/128, 24/27, 669, 702

[56] References Cited

U.S. PATENT DOCUMENTS

| | | | |
|---|---|---|---|
| 300,488 | 6/1884 | Lehmann | 63/13 |
| 868,298 | 10/1907 | Siner | 24/702 |
| 1,898,212 | 2/1933 | Polcini | 24/128 R |
| 2,592,696 | 4/1952 | Hoody | 24/128 R |
| 2,615,227 | 10/1952 | Hornik | 63/2 |
| 3,673,815 | 7/1972 | Pintarelli | 63/12 |
| 4,262,391 | 4/1981 | Peash | 24/27 |
| 4,781,037 | 11/1988 | Willibald | 63/13 |

FOREIGN PATENT DOCUMENTS

| | | | |
|---|---|---|---|
| 1087388 | 9/1956 | Germany | 63/2 |
| 901721 | 7/1962 | United Kingdom | 63/2 |

*Primary Examiner*—Flemming Saether

*Attorney, Agent, or Firm*—Antonio R. Durando; Harry M. Weiss

[57] ABSTRACT

An earring clasp that consists of a resilient looped ear wire with two ends coming together to a nearly abutting position. A bead with a slot capable of receiving one, free, end of the wire is incorporated in the other end, so that the two ends may be coupled by sliding or snapping the free end into the slot and are kept in place by the resilience of the slot and the wire. The ear wire may be shaped to possess its own ornamental characteristics or it can be used simply as a support ring for separate, interchangeable, accessory pendant earrings mounted on it according to the user's wishes. In another embodiment of the invention, a stop is incorporated in the tip of the free end of the wire and a corresponding notch is added to the slotted bead at the other end of the wire to improve the reliability of the connection between the two.

20 Claims, 1 Drawing Sheet

SNAP-ON EARRING CLASP

BACKGROUND OF THE INVENTION

1. Field of the Invention

This invention pertains to the general field of fasteners for earrings. In particular, it provides a new and improved way of coupling the ends of ear wires in pierced-ear earrings to ensure a fail-safe connection.

2. Description of the Prior Art

The common way of securing pierced-ear earrings to the ear of a wearer is to thread the pierced lobe with a wire or stud attached to the earring and then insert a clasp around the tip of the stud. The clasp thus prevents the stud from sliding out of the ear. The problem with this kind of securing mechanism is that it involves two separate pieces of hardware, the earring and the clasp, that may be difficult to manipulate into the correct position for clasping while holding the earring portion in place through the earlobe. Moreover, if the clasp is lost, the corresponding earring can no longer be used by itself.

Another common device consists of a looped ear wire that is threaded through the lobe and kept in vertical position by the weight of the earring, so that it hangs from the loop and is kept in place by its own mass. No clasp or other fastening device is used. The problem with this kind of apparatus is that the earring may become caught in the hair of the wearer and the ear wire may be accidentally released. When that happens, light earrings are commonly lost because the wearer cannot feel the ear wire slipping out of the ear.

Several prior art patents describe various types of fastening means for earrings. In U.S. Pat. No. 4,829,789 (1989), Tsamas discloses an earring that provides variable gripping pressure around the earlobe. A base pivotally supports a clasp, so that the clasp grips the ear between the base and the clasp. A pressure controller is slidably mounted on a center prong in the clasp, so that by sliding the pressure controller the gripping pressure of the clasp may be decreased or increased as desired.

In U.S. Pat. No. 4,242,886 (1981), Tucker describes an earring stay consisting of two separate parts. These include a tube portion and a shaft portion which enter the pierced lobe and which are smooth inside and out. The male shaft fits snugly inside the hollow tube portion of its female counterpart protruding through the aperture in the lobe, and is held in place by vacuum, friction, or the pressure of an attached earring clasp. A platform at each surface of the earlobe is also provided so that the earring can be clamped firmly against the platforms and will exert less pressure on the earlobe.

In U.S. Pat. No. 4,003,217 (1977), Evans et al. describe an earring construction for a pierced ear in which the earring is provided with a gap for receiving the ear lobe. The pin or ear wire which passes through the earlobe and bridges the gap features a ball that allows the pin or ear wire to be swiveled in any direction, such as a universal joint. Thus, the wearer can push the pin or wire into the most comfortable position or angle through the earlobe. The other end of the earring is provided with a slot for receiving the end of the pin or wire.

In U.S. Pat. No. 3,673,815 (1972), Pintarelli describes an earring including an elongated bar having spaced free ends and a substantially u-shaped ear wire pivotally connected to the bar adjacent to one of the free ends. The other end of the ear wire is removably connected to the bar for mounting of the earring on a wearer's earlobe by insertion through a laterally extending slot formed in the bar.

It is clear that these patents describe rather cumbersome, multicomponent, hardware and that there still exists a need for a simple earring clasp design. It is the purpose of this invention to address and solve the problems mentioned above. Accordingly, a new method of attachment has been developed consisting of a fastening structure that performs the function of a standard clasp but is an integral part of the earring itself, so that it cannot be lost and is automatically lined up for fastening around the ear of a user. The design of this invention is simple and requires little manual dexterity on the part of a user.

BRIEF SUMMARY OF THE INVENTION

One objective of this invention is an earring clasp that does not involve two separate pieces of hardware, so that the possibility of loosing parts is minimized and the process of mounting the earring on an earlobe is simplified.

Another objective of the invention is a light-weight design for comfort and versatility of use, such as in combination with charms, beads and pendants.

Another goal is a simple design, so that the earring may be produced economically utilizing simple components that are either already available in the open market or can be produced at competitive prices.

In accordance with these and other objectives, one embodiment of this invention consists of a resilient looped ear wire with two ends coming together to a nearly abutting position. A bead with a slot capable of receiving one, free, end of the wire is incorporated in the other end, so that the two ends may be coupled by sliding or snapping the free end into the slot and are kept in place by the resilience of the slot and the wire. The ear wire may be shaped to possess its own ornamental characteristics or it can be used simply as a support ring for separate, interchangeable, accessory pendant earrings mounted on it according to the user's wishes. In another embodiment of the invention, a stop is also incorporated in the tip of the free end of the wire and a corresponding notch is added to the slotted bead at the other end of the wire to improve the reliability of the connection between the two.

Various other purposes and advantages of this invention will become clear from its description in the specification that follows, and from the novel features particularly pointed out in the appended claims. Therefore, to the accomplishment of the objectives described above, this invention consists of the features hereinafter illustrated in the drawings, fully described in the detailed description of the preferred embodiments and particularly pointed out in the claims. However, such drawings and description disclose only some of the various ways in which the invention may be practiced.

DETAILED DESCRIPTION OF THE INVENTION

The substance of this invention lies in the idea that a simple and effective clasp for fastening the two ends of an ear wire in an earring may be achieved by constructing the ear wire as a resilient loop with converging ends and by incorporating a bead in one end with a slot for receiving the other end. Because the dimensions of the bead need only be slightly larger than the size of the wire, this invention reduces the overall size and weight of the clasp when compared to conventional ear clips and similar fastening devices.

Figure 1:
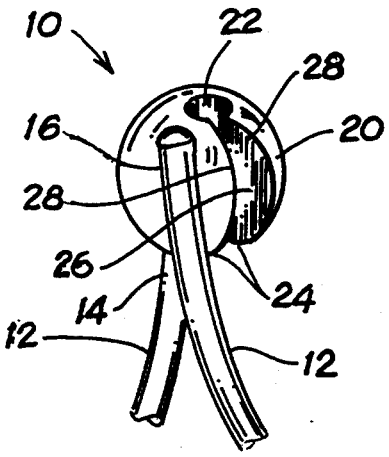
FIG. 1 illustrates an enlarged perspective view of one embodiment of the earring clasp of this invention wherein the two ends of the drop-shaped ear wire are shown open.

Referring to the drawings, wherein the same numerals and symbols are used throughout to refer to the same parts in the various figures, FIG. 1 illustrates an enlarged perspective view of one embodiment of the earring clasp 10 of this invention, wherein the two ends 14 and 16 of a looped ear wire 12 (illustrated without the loop in FIG. 1) are shown unfastened and apart. Incorporated at the tip of one end 14 of the wire is a bead 20, which consists of an end portion attached to the wire (illustrated as spherical, but which could have any other shape) larger than the diameter of the wire 12, featuring a slot 22 capable of receiving and holding in place the other, free, end 16 of the wire. The slot 22 is formed in the bead 20 by drilling (or forming by equivalent means) a longitudinal (that is, parallel to the longitudinal axis of the wire end 14) cylindrical perforation within the bead, resulting in the donut-shaped structure seen in the figures. Although not critical to the invention, it is preferable that this axial perforation be only slightly larger than the diameter of the wire, so that the free end 16 can fit snugly into it. The slot 22 is then completed by cutting an opening 24 along the perimeter of the donut-shaped structure in parallel relationship to the free end 16 (and therefore also to the longitudinal perforation), thus forming two jaws 28 leading to the slot 22. At its narrowest point, the width of the opening 24 is required to be slightly smaller than the diameter of the free end 16 (such as, for example, by a few hundredths of a millimeter), in order to provide a retaining structure to keep the free end 16 in place after its insertion into the slot 22. Each jaw 28 may be cut at an angle to form a beveled surface 26 leading to the jaws' narrowest open point along the inside wall of the slot 22, so that the process of pushing the free end 16 into the slot may be facilitated by the converging shape of two facing beveled surfaces 26.

Although readily apparent from the figures, it is to be noted that the exact position of the bead 20 and the slot 22 in relation to the wire end 14 must be such that the free end 16 can be inserted into the slot without interference by the wire end 14. That is, for instance, in the case of a spherical bead the end 14 should be attached to the bead tangentially, rather than coaxially. Similarly, although not critical to the function of the invention, it is important that sufficient space be present between the bead 20 and the free end 16, when unfastened, to allow the easy insertion of the free end into a user's earlobe. The opening 24 may be cut anywhere along the perimeter of the bead structure, so long as parallel to the free end, so that the two may be cooperatively engaged to close the clasp.

Figure 2:
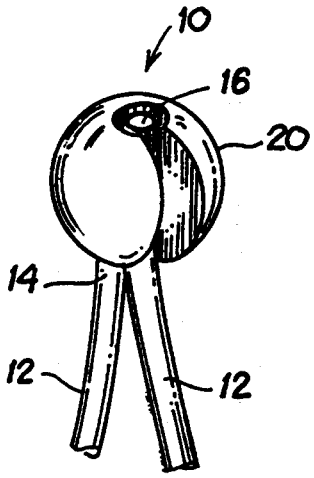
FIG. 2 illustrates the same earring clasp of FIG. 1 after the two ends are fastened together to form a closed ear wire loop.

The material constituting both the looped ear wire 12 and the bead 20 must have the characteristics of hardness and resilience, for durability and for functional operability. In use, the looped ear wire 12 is threaded into the user's earlobe through the free end 16, which is then snapped into the slot 22 in the bead 20 at the other end of the loop, as illustrated in FIG. 2. During the snapping procedure, the resilience of the material makes it possible for the jaws 28 to open sufficiently to allow the introduction of the free end 16 into the slot, and then to return to their original closed position to retain the clasped free end in place. When the free end is snapped out of the slot to remove the earring, the resilience of the material will also cause the looped ear wire to return to its original shape with a gap between the free end and the bead.

Figure 3:
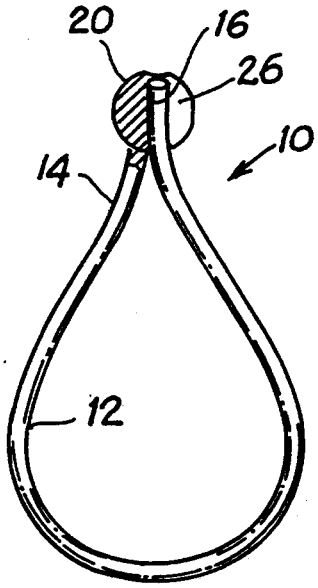
FIG. 3 is an elevational view of the ear wire and clasp assembly of FIG. 1, wherein the bead of the clasp is shown in partly cutout view to illustrate the mounting of the free end of the wire in the slot of the bead.
Figure 4:
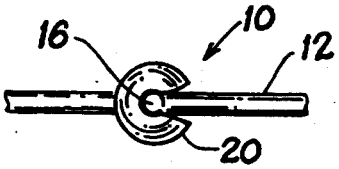
FIG. 4 is a plan view of the ear wire and clasp assembly of FIG. 3, wherein the entire bead is shown.

FIGS. 3 and 4 illustrate the ear wire and clasp assembly detailed above in elevational and plan views. It is apparent from the illustration that the ear wire itself, without additional decorative ornamentation, can be used as an earring.

On the other hand, the ear wire 12 can be utilized as a ring to support charms, beads or any other pendant that a user wishes to add to it.

In another embodiment 30 of the invention seen in FIGS. 5–8, the free end 16 of the ear wire 12 features an enlarged tip or stop 32 and the slot 22 features a conforming seat 34 where the stop 32 fits when the two ear-wire ends are snapped together. Although functionally the same as the embodiment 10 detailed above, the earring clasp 30 is designed for a ring-shaped ear wire, as opposed to the drop-shaped ear wire of the first embodiment. As a result of the ring-shaped configuration of the clasp 30, any tensile force applied to the ear wire 12, such a by an earlobe pulling up and a charm pulling down, could cause the free end 16 to slide out of the slot 22 even without snapping out of it. The purpose of the stop 32 is to prevent this accidental occurrence. Obviously, the direction of convergence of the two ends 14 and 16 in the clasp 10 of the first embodiment is opposite to the direction in the second embodiment, so that the protective stop 32 and seat 34 are not necessary to ensure a reliable fastening action by the clasp 10.

Figure 8:
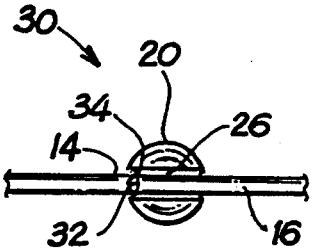
FIG. 8 is a partial plan view of the ear wire and clasp assembly of FIG. 7.
Figure 7:
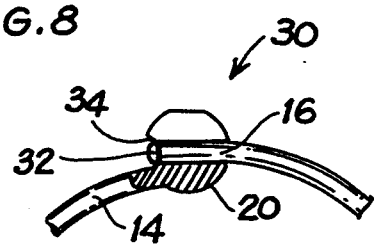
FIG. 7 is an elevational view of the ear wire and clasp assembly of FIG. 1, wherein the bead of the clasp is shown in partly cutout view to illustrate the mounting of the stop in the free end of the wire in the slot of the bead.
Figure 5:
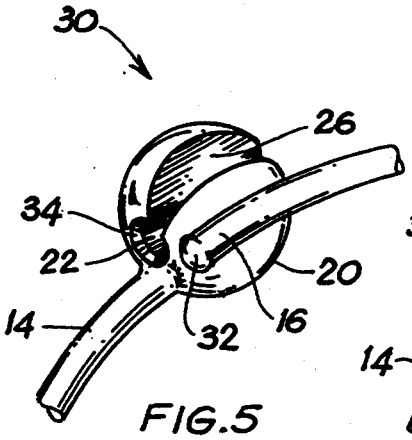
FIG. 5 illustrates an enlarged perspective view of another embodiment of the earring clasp of this invention wherein the two ends of the ring-shaped ear wire are shown open.
Figure 6:
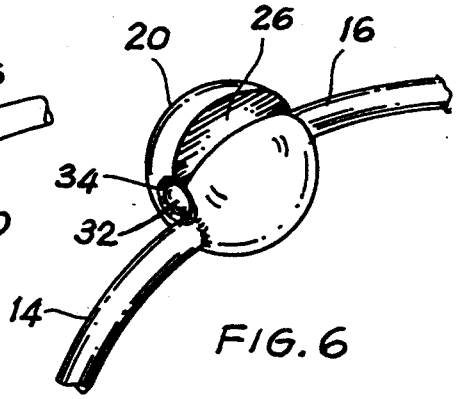
FIG. 6 illustrates the same earring clasp of FIG. 5 after the two ends are fastened together to form a closed ear-wire loop.

As in the case of the first embodiment, the looped ear wire 12 and the bead 20 of the clasp 30 are constructed with hard and resilient material. In operation, the ring of the ear wire 12 is threaded into the user's earlobe through the free end 16, which is then snapped into the slot 22 in the bead 20 at the other end of the loop, causing the stop 32 to fit into, or at least be in coaxial position and ready for engagement with, the seat 34, as illustrated in FIG. 6. FIGS. 7 and 8 illustrate the ear wire and clasp assembly 30 in elevational and plan views. As in the case of the first embodiment, it is apparent from the illustrations that the ring-shaped ear wire itself can be used as an earring, or it can be utilized as a ring to support ornamental pendants.

It is understood that the invention has been described for an ear wire of circular cross-section, which will normally be the case in practice. The same concept would work, though, for any cross-sectional shape so long as the minimum opening between the jaws of the slot 22 in the bead is slightly smaller than the minimum dimension in the cross-section of the ear wire.

Various changes in the details, steps and materials that have been described may be made by those skilled in the art within the principles and scope of the invention herein illustrated and defined in the appended claims. Therefore, while the present invention has been shown and described herein in what is believed to be the most practical and preferred embodiment, it is recognized that departures can be made therefrom within the scope of the invention, which is therefore not to be limited to the details disclosed herein but is to be accorded the full scope of the claims so as to embrace any and all equivalent apparatus and methods.

I claim:

1. A clasp assembly for fastening the two ends of a looped ear wire, comprising:
   (a) a resilient looped ear wire having a first and a second end coming together; and
   (b) a bead attached to the first end of said ear wire, said bead being larger than the diameter of the ear wire and containing a resilient slot capable of receiving and holding in place the second end of said ear wire.

2. The assembly described in claim 1, wherein said slot consists of a longitudinal perforation through the bead and of an opening in the bead forming two retaining jaws at the perimeter of the perforation, said perforation being slightly larger and said opening between the jaws being slightly smaller than the diameter of said ear wire, so that the second end of the ear wire fits snugly into the perforation, and so that the jaws provide a retaining structure to keep said second end in place after it is inserted into the slot and the two ear-wire ends are snapped together.

3. The assembly described in claim 2, wherein said opening in the bead forming two retaining jaws at the perimeter of the perforation is cut at an angle to form two beveled surfaces leading to the slot, so that the process of snapping the second end of said ear wire into said slot may be facilitated.

4. The assembly described in claim 1, further comprising a stop attached to the tip of the second end and a conforming seat in the slot of said bead attached to the first end of said ear wire, said stop being shaped to fit into said seat when the two ear-wire ends are snapped together.

5. The assembly described in claim 4, wherein said ear wire is ring-shaped.

6. The assembly described in claim 1, wherein said ear wire is drop-shaped.

7. The assembly described in claim 1, wherein said ear wire has a circular cross-section.

8. A method of fastening the two ends of a looped ear wire, comprising the following steps:
   (a) providing a looped ear wire made of resilient material and having a first and a second end coming together;
   (b) attaching a bead to the first end of said ear wire, said bead being larger than the diameter of the ear wire, and cutting a resilient slot into said bead capable of receiving and holding in place the second end of said ear wire; and
   (c) pushing said second end of the ear wire against said bead in order to cause the second end to snap into said slot.

9. The method described in claim 8, wherein said slot consists of a longitudinal perforation through said bead and of an opening in the bead forming two retaining jaws at the perimeter of the perforation, said perforation being slightly larger and said opening between the jaws being slightly smaller than the diameter of said ear wire, so that the second end of the ear wire fits snugly into the perforation, and so that the jaws provide a retaining structure to keep said second end in place after it is snapped into the slot.

10. The method described in claim 9, wherein said opening in the bead forming two retaining jaws at the perimeter of the perforation is cut at an angle to form two beveled surfaces leading to the slot, so that the process of snapping the second end of said ear wire into said slot may be facilitated.

11. The method described in claim 8, further comprising the step of providing a stop attached to the tip of the second end and a conforming seat in the slot of said bead attached to the first end of said ear wire, said stop being shaped to fit into said seat when the two ear-wire ends are snapped together.

12. The method described in claim 11, wherein said ear wire is ring-shaped.

13. The method described in claim 8, wherein said ear wire is drop-shaped.

14. The method described in claim 8, wherein said ear wire has a circular cross-section.

15. A clasp assembly for fastening the two ends of a single-piece, looped ear wire, comprising:
   (a) a resilient, single-piece, looped ear wire having a first end and a second end coming together to form a resilient, closed-loop structure; and
   (b) a bead attached to the first end of said ear wire, said bead being larger than the diameter of the ear wire and containing a resilient slot capable of receiving and holding in place the second end of said ear wire.

16. The assembly described in claim 15, wherein said slot consists of a longitudinal perforation through the bead and of an opening in the bead forming two retaining jaws at the perimeter of the perforation, said perforation being slightly larger and said opening between the jaws being slightly smaller than the diameter of said ear wire, so that the second end of the ear wire fits snugly into the perforation, and so that the jaws provide a retaining structure to keep said second end in place after it is inserted into the slot and the two ear-wire ends are snapped together.

17. The assembly described in claim 16, wherein said opening in the bead forming two retaining jaws at the perimeter of the perforation is cut at an angle to form two beveled surfaces leading to the slot, so that the process of snapping the second end of said ear wire into said slot may be facilitated.

18. The assembly described in claim 15, further comprising a stop attached to the tip of the second end and a conforming seat in the slot of said bead attached to the first end of said ear wire, said stop being shaped to fit into said seat when the two ear-wire ends are snapped together.

19. The assembly described in claim 18, wherein said ear wire is ring-shaped.

20. The assembly described in claim 15, wherein said ear wire is drop-shaped.

* * * * *